US006592214B2

(12) United States Patent
Shimosato

(10) Patent No.: US 6,592,214 B2
(45) Date of Patent: Jul. 15, 2003

(54) INK-JET HEAD, INK-JET HEAD WITH BUBBLE EXTRACTING DEVICE, AND INK-JET TYPE PRINTING APPARATUS

(75) Inventor: Masashi Shimosato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/973,346

(22) Filed: Oct. 9, 2001

(65) Prior Publication Data

US 2003/0067523 A1 Apr. 10, 2003

(51) Int. Cl.[7] ..... B41J 2/19; B41J 2/165
(52) U.S. Cl. ..... 347/92; 347/30
(58) Field of Search ..... 347/92, 29, 30

(56) References Cited

U.S. PATENT DOCUMENTS 4,189,734 A 2/1980 Kyser et al.
4,536,777 A 8/1985 Matsumoto
5,128,690 A * 7/1992 Nozawa ..... 347/30
5,394,181 A * 2/1995 Braun ..... 347/92
6,000,792 A * 12/1999 Koizumi et al. ..... 347/89
6,017,109 A * 1/2000 Saijo ..... 347/30

FOREIGN PATENT DOCUMENTS

JP 64-90754 A 4/1989
JP 2-51734 B2 11/1990
JP 6-11542 B2 2/1994

* cited by examiner

*Primary Examiner*—Judy Nguyen
(74) *Attorney, Agent, or Firm*—Frishauf, Holtz, Goodman & Chick, P.C.

(57) ABSTRACT

An ink-jet type printing apparatus includes a recording medium conveyor device, an ink-jet head for forming an image on a conveyed medium, and a bubble extracting device. The ink-jet head has an ink storing chamber, orifices located under the chamber and extending downward from the chamber, ink ejection driving elements for ejecting ink from the orifices, and a bubble extracting path located aside from the orifices and extending downward from an upper part of the chamber. The extracting device extracts bubbles from the upper part of the chamber through the path while the orifices do not ejecting ink for forming the image.

11 Claims, 4 Drawing Sheets

INK-JET HEAD, INK-JET HEAD WITH BUBBLE EXTRACTING DEVICE, AND INK-JET TYPE PRINTING APPARATUS

BACKGROUND OF THE INVENTION

The present invention relates to an ink-jet head, an ink-jet head with a bubble extracting device for eliminating bubbles in the ink-jet head, and an ink-jet type printing apparatus using the ink-jet head.

Conventionally, an ink-jet head which includes an ink storing chamber, at least one orifice having one end communicating with the ink storing chamber and the other end opened in an external space, and an ink ejection driving element provided in the orifice to eject ink in the orifice from the opening at the other end, has been well known.

An ink-jet type printing apparatus using the ink-jet head has such advantages that a constitution for color printing is simple, noise generated in the operation is small, and printing speed is high.

Each of Jpn. Pat. Appln. KOKOKU Publication No. 2-51734 and Jpn. Pat. Appln. KOKAI Publication No. 64-90754 discloses an ink-jet head. The ink-jet head disclosed in Jpn. Pat. Appln. KOKOKU Publication No. 2-51734 uses a piezoelectric element as an ink ejection driving element. The ink-jet head disclosed in Jpn. Pat. Appln. KOKAI Publication No. 64-90754 uses a heating resistor as an ink ejection driving element.

The ink-jet head applies a kinetic energy such as a pressure to ink in the orifice by the ink ejection driving element mounted therein and ejects the ink in the orifice from the opening at the other end. However, when bubbles are included in the ink stored in the orifice or in the vicinity of the end of the orifice in the ink storing chamber, the pressure applied to the ink by the ink ejection driving element is absorbed into the bubbles. Consequently, the ink in the orifice is not ejected from the opening at the other end. Even if bubbles are included in the ink in the ink storing chamber communicating with the orifice, a proper generation of the pressure or a proper supply of the ink from the ink storing chamber to the orifice is deteriorated in some cases.

Mixing of bubbles into ink in the orifice or in the ink storing chamber is easily caused when the ink is supplied from the outside to the ink storing chamber. While the ink-jet head is being used, the air in the external space may be mixed into the ink in the orifice or ink storing chamber via the opening at the other end of the orifice.

In the conventional ink-jet head, to eliminate bubbles mixed in ink in the orifice or in the ink storing chamber to the external space, after completion of a desired printing operation, a pressure is applied from the outside to the ink in the ink storing chamber to push out the ink in the orifice to the external space via the opening at the other end. Alternatively, a negative pressure is applied to the ink in the orifice through the opening at the other end to suck out the ink in the orifice to the external space through the opening at the other end.

In the conventional operation to eliminate mixed bubbles, it is relatively easy to eliminate bubbles mixed in a small amount of ink in the orifice. However, to eliminate bubbles mixed in a large amount of ink in the ink storing chamber, it is necessary to discharge the large amount of ink in the ink storing chamber. Even then, it is difficult to eliminate the bubbles mixed in the large amount of ink.

Jpn. Pat. Appln. KOKOKU Publication No. 6-11542 discloses a constitution which easily and efficiently discharge bubbles included in a large amount of ink in an ink storing chamber in an ink-jet head for ejecting ink in the horizontal direction to an external space. In the constitution, an orifice for ink ejection is horizontally disposed in the ink-jet head, one end of the ink ejection orifice communicates with the ink storing chamber and the other end is opened in the external space. Furthermore, in the ink-jet head, a bubble discharging path is horizontally arranged above the ink ejection orifice independently of the ink ejection orifice. One end of the bubble discharging path communicates with the ink storing chamber and the other end faces upward and is opened in the external space.

However, the constitution for eliminating mixed bubbles in the ink-jet head disclosed in Jpn. Pat. Appln. KOKOKU Publication No. 6-11542 is made on the assumption that the ink-jet head is used in a state where the ink ejection orifice is held substantially horizontally. Accordingly, when the ink-jet head is used in a state where the opening at the other end of the ink ejection orifice faces downward, the constitution does not favorably function.

In an ink-jet type printing apparatus using the ink-jet head in a state where the opening at the other end of the ink ejection orifice faces downward, the gravity can be used for ink ejection from the opening at the other end of the ink ejection orifice. Accordingly, the apparatus has such advantages that the structure of an ink ejection driving element can be easily made. The ink-jet type printing apparatus can easily and horizontally hold a recording medium while a desired image is formed on the recording medium on which the desired image to be formed. Accordingly, the surface of the recording medium is not distorted so that the printing apparatus has such advantages that a desired image can be accurately printed on the surface of the recording medium.

Accordingly, it is necessary to provide an ink-jet head which is used in a state where an opening at the other end of an ink ejection orifice faces downward and which can easily eliminate bubbles in ink in the ink ejection orifice and can also easily eliminate bubbles in an ink storing chamber.

Furthermore, it is necessary to provide an ink-jet head with a bubble extracting device for eliminating a bubble in the ink-jet head and an ink-jet type printing apparatus using the ink-jet head.

BRIEF SUMMARY OF THE INVENTION

According to a plurality of embodiments of the present invention, there is provided an ink-jet head including a member having an ink storing chamber to which ink is supplied from the outside, wherein the member includes:

- at least one orifice which is mounted below the ink storing chamber and includes an end communicating with the ink storing chamber and the other end opened in an external space below the end;
- an ink ejection driving element which is mounted to correspond to the orifice and ejects ink in the orifice from the opening at the other end; and
- a bubble extracting path including an end communicating with an upper portion of the ink storing chamber and the other end opened in the vicinity of the opening at the other end of the orifice.

According to the embodiments of the present invention, there is provided an ink-jet head with a bubble extracting device which eliminates bubbles in the ink-jet head, the head including a member having an ink storing chamber to which ink is supplied from the outside, wherein the member includes:

at least one orifice which is mounted below the ink storing chamber and includes an end communicating with the ink storing chamber and the other end opened in an external space below the end;

an ink ejection driving element which is mounted to correspond to the orifice and ejects ink in the orifice from the opening at the other end; and a bubble extracting path including an end communicating with an upper portion of the ink storing chamber and the other end opened in the vicinity of the opening at the other end of the orifice, and while ink is not ejected from the opening at the other end of the orifice by the ink ejection driving element, the bubble extracting device sucks ink from the bubble extracting path and the upper portion of the ink storing chamber through the opening at the other end of the bubble extracting path.

According to the embodiments of the present invention, there is provided an ink-jet type printing apparatus which forms a desired image on a recording medium, the apparatus comprising:

a recording medium conveyor device which conveys the recording medium;

an ink-jet head which faces the recording medium conveyed by the recording medium conveyor device and forms a desired image on the conveyed recording medium; and a bubble extracting device which eliminates bubbles in the ink-jet head, wherein the ink-jet head includes a member having an ink storing chamber to which ink is supplied from the outside;

the member includes at least one orifice which is mounted below the ink storing chamber and includes an end communicating with the ink storing chamber and the other end opened in an external space below the end, an ink ejection driving element which is mounted to correspond to the orifice and ejects ink in the orifice from the opening at the other end, and a bubble extracting path including an end communicating with an upper portion of the ink storing chamber and the other end opened in the vicinity of the opening at the other end of the orifice, and the bubble extracting device sucks ink from the bubble extracting path and the upper portion of the ink storing chamber through the opening at the other end of the bubble extracting path while ink is not ejected from the opening at the other end of the orifice by the ink ejection driving element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
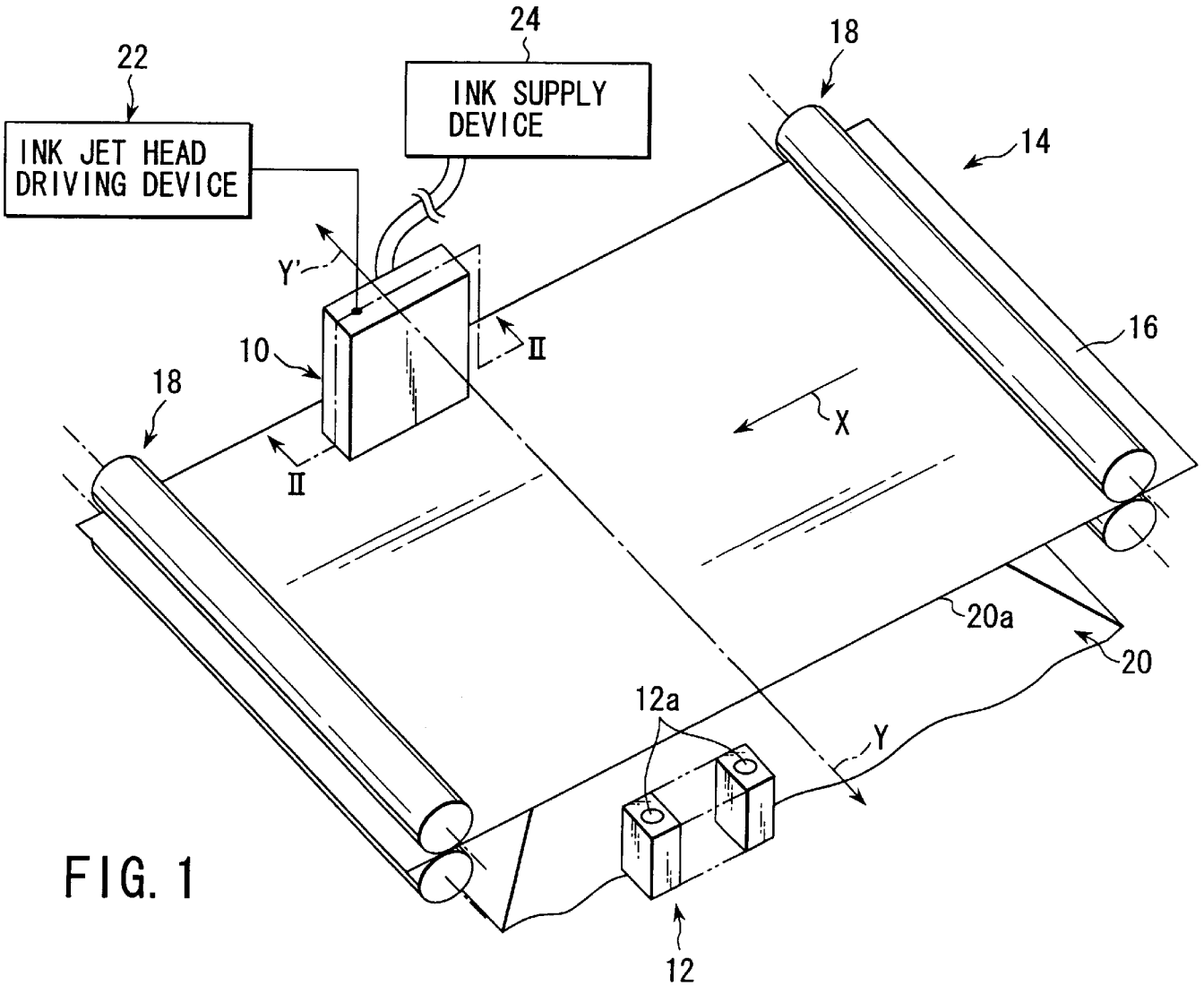
FIG. 1 is a perspective view schematically showing a configuration of an ink-jet type printing apparatus including an ink-jet head according to an embodiment of the present invention and a bubble extracting device used in combination with the ink-jet head.

At first, a configuration of an ink-jet type printing apparatus 14, which includes an ink-jet head 10 according to an embodiment of the present invention and a bubble extracting device 12 used in combination with the ink-jet head 10, will now be described schematically with reference to FIG. 1.

The ink-jet type printing apparatus 14 is configured to form a desired image on a recording medium 16. The apparatus 14 has a recording medium conveyor device 18 for intermittently conveying the recording medium 16 in a predetermined direction (shown by an arrow X in FIG. 1) at predetermined speed. According to the present embodiment, the recording medium 16 is a paper sheet having a predetermined size and a predetermined shape. The recording medium conveyor device 18 includes a plurality of recording medium conveying roller pairs. A rotation driving source (not shown) transmits a rotating force to each pair of recording medium conveying rollers and controls rotational speed thereof. The recording medium conveyor device 18 has been widely known in the technical field to which the conveyer device 18 pertains. The recording medium conveyor device 18 conveys the recording medium 16 in a horizontal state.

Between predetermined two pairs of recording medium conveying rollers, the recording medium conveyor device 18 further includes a platen 20 having a recording medium supporting guide surface 20*a* extending in parallel to a horizontal moving path of the recording medium 16 between the predetermined two pairs of recording medium conveying rollers. The recording medium supporting guide surface 20*a* of the platen 20 is adjacent to the horizontal moving path of the recording medium 16 between the predetermined two pairs of recording medium conveying rollers. Consequently, the recording medium 16 conveyed between the predetermined two pairs of recording medium conveying rollers is supported in the horizontal state by the recording medium supporting guide surface 20*a* of the platen 20, so that it is not bent downward.

An ink-jet head driving device 22 supports the ink-jet head 10 above the recording medium 16 between the predetermined two pairs of recording medium conveying rollers so as to be movable in two directions (shown by arrows Y and Y' in FIG. 1) horizontally perpendicular to the predetermined conveying direction (shown by the arrow X in FIG. 1) of the recording medium 16 at predetermined speed.

The ink-jet head 10 is connected to an ink supply device 24. Ink of a desired color is supplied from the ink supply device 24 to the ink-jet head 10. The ink-jet head 10 has a plurality of orifices, which open toward the recording medium 16 on the platen 20, on the bottom surface. The openings of the orifices are arranged at predetermined intervals in the predetermined conveying direction (shown by the arrow X in FIG. 1) of the recording medium 16.

While the conveyance of the recording medium 16 is stopped between the predetermined two pairs of recording medium conveying rollers for a predetermined period, the ink-jet head driving device 22 moves the ink-jet head 10 in the two directions (shown by the arrows Y and Y' in FIG. 1) or in one of the two directions horizontally perpendicular to the conveying direction at the predetermined speed. In the movement, the ink-jet head driving device 22 also controls the ink-jet head 10 so as to eject ink from the predetermined one or plurality of openings of the orifices to the recording medium 16 at a plurality of predetermined positions in the two directions horizontally perpendicular to the conveying direction above the stopped recording medium 16. Consequently, a desired ink image is formed in an area through which the ink-jet head 10 passes above the stopped recording medium 16.

Subsequently, the recording medium conveyor device 18 conveys the recording medium 16 at the predetermined speed for the predetermined period and, after that, temporarily stops the conveyance. In this instance, the ink-jet driving device 22 moves the ink-jet head 10 in the two directions or in one of the two directions and makes the head 10 eject the ink to the upper surface of the recording medium 16 which is stopped. Consequently, as mentioned above, a desired ink image is formed in an area through which the ink-jet head 10 passes above the stopped recording medium 16.

A distance through which the recording medium conveyor device 18 conveys the recording medium 16 at one time during the conveyor device 18 intermittently conveys the recording medium 16 is so set that the distance is equal to the maximum separating distance between the openings of the orifices of the ink-jet head 10 in the predetermined recording medium conveying direction (shown by the arrow X in FIG. 1).

Accordingly, while the recording medium conveyor device 18 intermittently conveys the recording medium 16 on the recording medium supporting guide surface 20*a* of the platen 20 between the predetermined two pairs of recording medium conveying rollers at the predetermined conveying speed as mentioned above, the ink-jet head driving device 22 repetitively and intermittently moves the ink-jet head 10 in the two directions (shown by the arrows Y and Y' in FIG. 1) horizontally perpendicular to the conveying direction or in the one of the two directions at the predetermined speed and makes the head 10 eject ink from the predetermined one or plurality of orifices to the recording medium 16, so that a desired image can be formed in a desired area on the upper surface of the recording medium 16.

The movement range of the ink-jet head 10 in the two directions (shown by the arrows Y and Y' in FIG. 1) horizontally perpendicular to the conveying direction is set so as to be larger than the size (generally, the width) of the recording medium supporting guide surface 20*a* of the platen 20 or the size (width) of the recording medium 16 thereon between the predetermined two pairs of recording medium conveying rollers in the two directions. In the movement range, at a predetermined position on either one of both side edges located in the width direction of the recording medium supporting guide surface 20*a* of the platen 20 or the recording medium 16 thereon, the bubble extracting device 12 is disposed so as to face the bottom surface of the ink-jet head 10 arranged at the predetermined position. The bubble extracting device 12 is used to eliminate bubbles in the ink-jet head 10.

The predetermined position is called as a maintenance position or a rest position.

The above movement range has a home position located outside of the maintenance position or rest position. When the ink-jet head 10 is not used for a predetermined time or more, the ink-jet head 10 is disposed at the home position.

Figure 2:
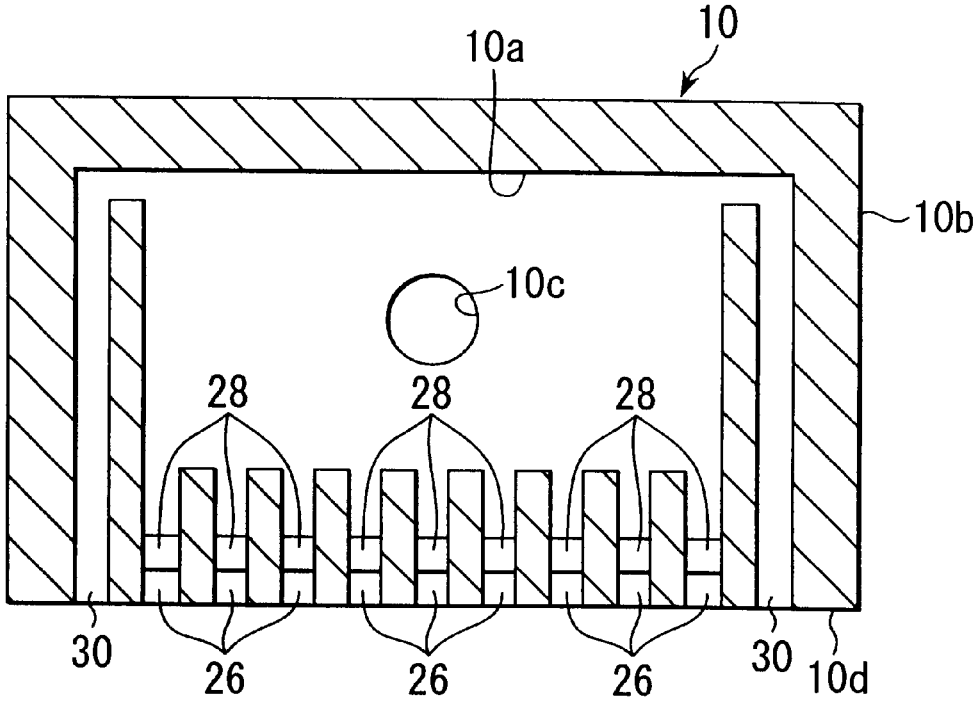
FIG. 2 is a schematic vertical cross-sectional view of the ink-jet head according to the embodiment of the present invention, the view being taken along a line II—II in FIG. 1, in which ink is not shown in order to clearly show an ink storing chamber, a plurality of orifices, and bubble extracting paths as internal components of the ink-jet head.

Subsequently, the configuration of the ink-jet head 10 will now be described in detail with reference to FIG. 2. FIG. 2 is a schematic vertical cross sectional view of the ink-jet head 10 according to the embodiment of the present invention and is taken along the line II—II in FIG. 1. In FIG. 2, ink is not shown to clearly show the internal structure of the ink-jet head 10.

The ink-jet head 10 has a main body 10*b* including an ink storing chamber 10*a*. In the main body 10*b*, an ink introduction port 10*c*, which is opened in an external space in the upper portion of the ink storing chamber 10*a*, is formed. The ink introduction port 10*c* communicates with the ink supply device 24 (refer to FIG. 1). Ink from the ink supply device 24 is supplied to the ink storing chamber 10*a* through the ink introduction port 10*c*.

The ink-jet head 10 further has a plurality of orifices 26 disposed in a predetermined arrangement below the ink storing chamber 10*a* in the main body 10*b*. The orifices 26 are arranged at predetermined intervals in the recording-medium conveying direction X in FIG. 1 and each orifice has the same size and shape as to each other. Each orifice 26 has one end, which communicates with the ink storing chamber 10*a*, and the other end, which linearly extends downward from the end and is opened in the external space on a bottom surface 10*d* of the main body 10*b*.

An ink ejection driving element 28 is provided at a predetermined distance from the opening at the other end in each of the orifices 26. Each ink ejection driving element 28 applies a predetermined kinetic energy to the ink in the orifice 26 to which the driving element 28 corresponds while the orifice 26 is filled with ink, the ink is ejected from the opening at the other end by a predetermined pressure.

The operation of each of the ink ejection driving elements 28 of the orifices 26 is controlled by the ink-jet head driving device 22 (refer to FIG. 1).

In the present embodiment, the ink ejection driving element 28 is a heating resistor. The ink ejection driving element 28 as a heating resistor is instantaneously heated by the ink-jet head driving device 22 (refer to FIG. 1) while the corresponding orifice 26 is filled with ink. Bubbles occur in the ink corresponding to the heated ink ejection driving element 28. Due to a predetermined pressure generated by the bubbles, a predetermined kinetic energy is applied to a predetermined amount of ink in a range from the ink ejection driving element 28 (bubble generating position) to the opening at the other end in the corresponding orifice 26 and ejects the predetermined amount of ink from the opening at the other end downward.

In the main body 10*b* of the ink-jet head 10, a pair of bubble extracting paths 30 are formed in both sides of the orifices 26 in the arranging direction of the orifices 26. Each of the pair of bubble extracting paths 30 extends in the same direction as that of each orifice 26. Each path 30 includes one end, which communicates with the upper portion of the ink storing chamber 10*a,* and the other end, which is arranged so as to be adjacent to the opening at the other end of the orifice 26 at either end of the arrangement of the other end of the openings.

Figure 3:
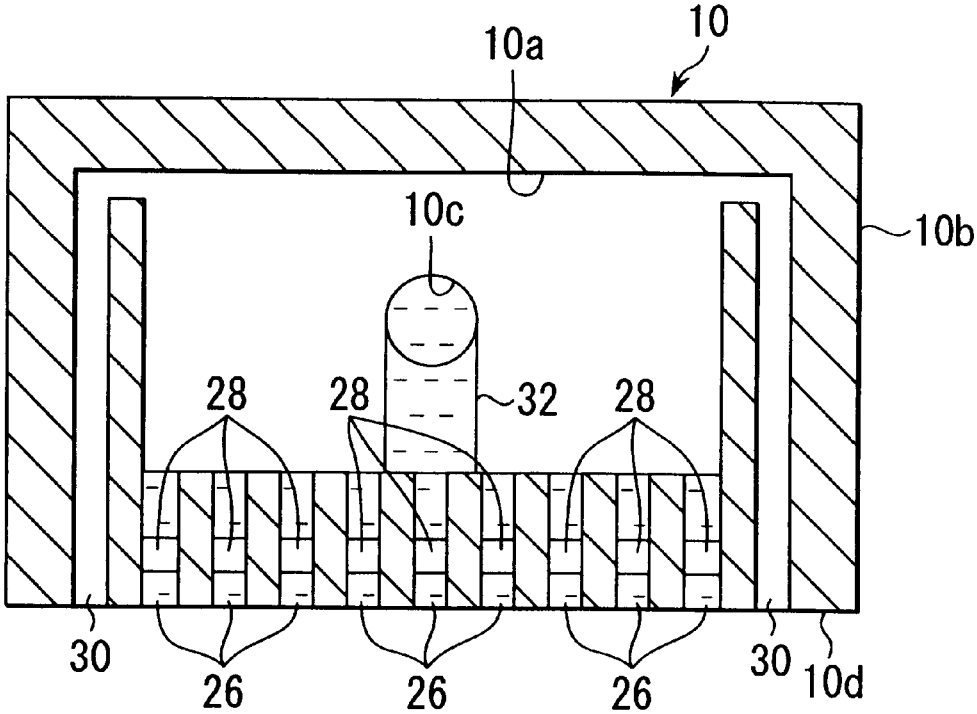
FIG. 3 is a schematic vertical cross-sectional view showing a state in which while ink is supplied from the outside to the ink storing chamber of the ink-jet head in FIG. 2 through an ink introduction port, the plurality of orifices are filled with the ink.

When the orifices 26 and the ink storing chamber 10*a* in the ink-jet head 10 configured as mentioned above are not filled with ink and it is necessary to fill them with ink, ink 32 is supplied from the ink supply device 24 to the ink storing chamber 10*a* of the ink-jet head 10 through the ink introduction port 10*c* while the ink-jet head 10 is located at the above-mentioned home position. The ink 32 supplied to each of the orifices 26 is not leaked out of the opening at the other end of the orifice 26 to the external space due to the surface tension of the ink. As shown in FIG. 3, the orifices 26 are filled with the ink 32.

Figure 4:
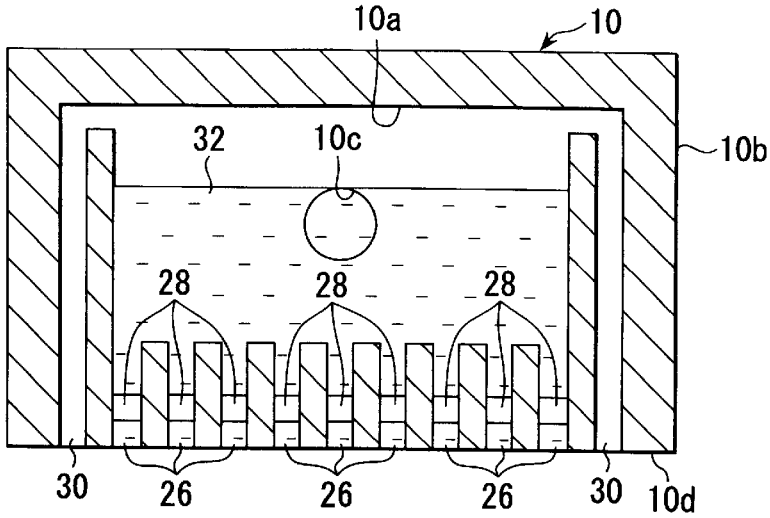
FIG. 4 is a schematic vertical cross-sectional view showing a state in which while the ink is supplied from the outside to the ink storing chamber of the ink-jet head in FIG. 2 through the ink introduction port, the air in the ink storing chamber is pushed out of the bubble extracting paths to an external space, so that ink is further introduced to the ink storing chamber to the upper portion over the ink introduction port.

When the amount of ink 32 supplied from the ink supply device 24 to the ink storing chamber 10*a* of the ink-jet head 10 through the ink introduction port 10*c* being increased, the air in the ink storing chamber 10*a* is discharged from the upper portion of the ink storing chamber 10*a* to the external space through the pair of bubble extracting paths 30. Accordingly, as shown in FIG. 4, the amount of ink 32 introduced into the upper portion of the ink storing chamber 10*a* can be increased even after exceeding the ink introduction port 10*c*.

When the ink 32 reaches the upper end of the ink storing chamber 10*a* and flows into the pair of bubble extracting paths 30 so that the ink 32 fills the pair of bubble extracting paths 30, the supply of ink 32 from the ink supply device 24 to the ink storing chamber 10*a* through the ink introduction port 10*c* is stopped. At that time, ink does not flow out of the opening at the other end of each of the pair of bubble extracting paths 30 due to the surface tension of the ink.

Figure 5:
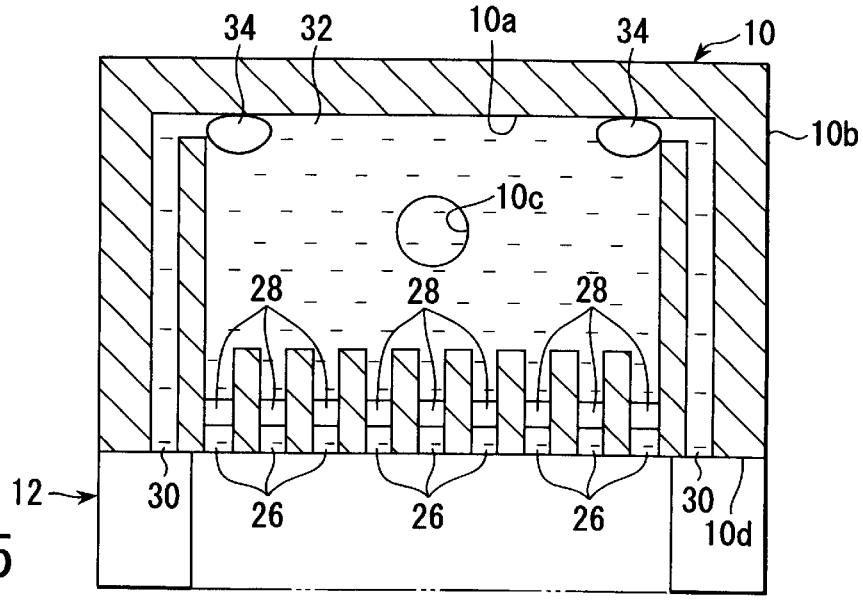
FIG. 5 is a schematic vertical cross-sectional view showing a state in which the ink storing chamber, the orifices, and the bubble extracting paths are filled with the ink supplied from the outside to the ink storing chamber of the ink-jet head shown in FIG. 2 through the ink introduction port but bubbles are remained in the upper portion of the ink storing chamber.

When the supply of ink is stopped, as shown in FIG. 5, bubbles 34, which are not smoothly discharged to the external space through the pair of bubble extracting paths 30, are remained in the upper portion of the ink storing chamber 10*a*. Bubbles may be remained in the orifices 26.

Subsequently, in order to discharge the remained bubbles 34 to the external space, the ink-jet head 10 is disposed at the maintenance position or rest position mentioned above with reference to FIG. 1. As shown in FIG. 5, the bubble extracting device 12 is in tightly contact with the bottom surface 10*d* of the ink-jet head 10 at the maintenance position or rest position.

The bubble extracting device 12 includes a pair of bubble extracting openings 12*a,* each of which faces the opening at the other end of each of the pair of bubble extracting paths 30 on the bottom surface, and an orifice bubble extracting opening (not shown), which faces the openings at the other ends of the orifices 26 arranged between the pair of bubble extracting paths 30 on the bottom surface.

The bubble extracting device 12 sucks ink 32 from the pair of bubble extracting paths 30 and the upper portion of the ink storing chamber 10*a* in the ink-jet head 10 through the pair of bubble extracting openings 12*a* and also sucks ink 32 in the orifices 26 through the orifice bubble extracting opening (not shown) arranged between the bubble extracting openings, so that the bubbles existing in the above described portions can be discharged together with the ink 32 sucked as mentioned above into a discarded ink receiver (not shown).

The sucking operation is performed for a predetermined period. According to experiences of the inventor, for the predetermined period, the bubbles are completely extracted from the pair of bubble extracting paths 30, the ink storing chamber 10*a,* and the orifices 26 in the ink-jet head 10 by the bubble extracting device 12.

The ink discharged from the pair of bubble extracting paths 30, the ink storing chamber 10*a,* and the orifices 26 in the ink-jet head 10 by the bubble extracting device 12 is compensated by newly supplying ink 32 from the ink supply device 24 via the ink introduction port 10*c*. Since ink 32 newly supplied from the ink supply device 24 to the ink storing chamber 10*a* in the compensation includes no air, a bubble does not occur in the ink storing chamber 10.

Figure 6:
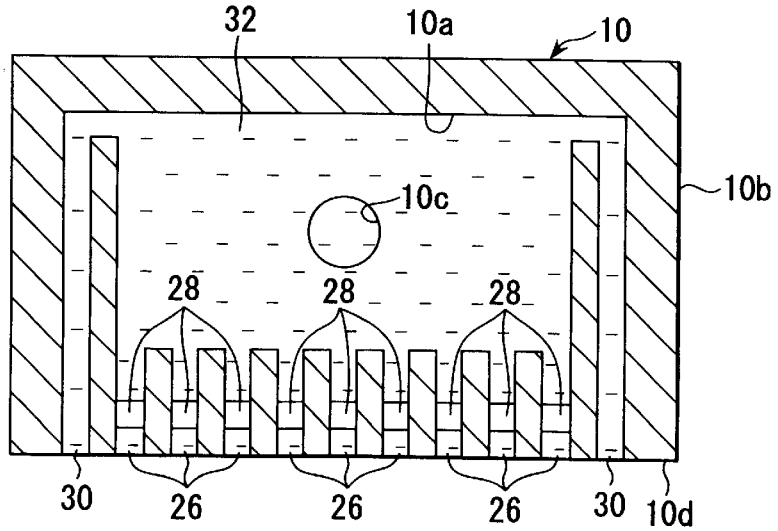
FIG. 6 is a schematic vertical cross-sectional view showing a state in which the bubbles remained in the upper portion of the ink storing chamber in the ink-jet head in FIG. 5 are discharged to the outside through the babble extracting paths by the bubble extracting device.

FIG. 6 shows the ink-jet head 10 in which the pair of bubble extracting paths 30, the ink storing chamber 10*a,* and the orifices 26 are filled with ink including no bubble.

According to the present embodiment, the bubble extracting device 12 can individually control the bubble extracting operation in the pair of bubble extracting openings 12*a* corresponding to the pair of bubble extracting paths 30 of the ink-jet head 10 and the bubble extracting operation in the orifice bubble extracting opening (not shown) corresponding to the orifices 26 of the ink-jet head 10. Accordingly, the bubble extracting device 12 can suck ink 32 including bubbles from the pair of bubble extracting paths 30 and the upper portion of the ink storing chamber 10*a* with the optimum suction pressure for the optimum sucking time to extract bubbles most efficiently from the pair of bubble extracting paths 30 and the ink storing chamber 10*a* in the ink-jet head 10 through the pair of bubble extracting openings 12*a*. Simultaneously, the bubble extracting device 12 can also suck ink 32 including/bubbles from the orifices 26 with the optimum suction pressure for optimum sucking time to extract bubbles most efficiently the orifices 26 of the ink-jet head 10 through the orifice bubble extracting opening (not shown).

Consequently, according to the present embodiment, the bubble extracting device 12 can extract bubbles most efficiently (namely, the minimum amount of discarded ink for the shortest time) from the pair of bubble extracting paths 30, the upper portion of the ink storing chamber 10*a,* and further, the orifices 26 in the ink-jet head 10.

Furthermore, according to the present embodiment, since the bubble extracting device 12 can individually control the bubble extracting operation in the pair of bubble extracting openings 12*a* corresponding to the pair of bubble extracting paths 30 of the ink-jet head 10 and the bubble extracting operation in the orifice bubble extracting opening (not shown) corresponding to the orifices 26 of the ink-jet head 10, the former bubble extracting operation and the latter bubble extracting operation can be individually performed as necessary.

Even after the ink-jet head 10 is used to record a desired image on the recording medium 16, while the pair of bubble extracting paths 30, the upper portion of the ink storing chamber 10*a*, and the orifices 26 in the ink-jet head 10 are filled with ink 32, bubbles may enter the ink through the openings at the other ends of the orifices 26 or bubbles may occur in the ink 32.

To prevent the case, after the ink-jet head 10 is used, the ink-jet head 10 is disposed at the maintenance position or rest position, so that the bubble extracting device 12 can efficiently extract bubbles in the ink-jet head 10 as mentioned above and the ink-jet head 10 can be ready for the next image forming operation.

The bubble extracting device 12 can be divided into a first portion having the pair of bubble extracting openings 12*a* corresponding to the pair of bubble extracting paths 30 of the ink-jet head 10 and a second portion having the orifice bubble extracting opening (not shown) corresponding to the orifices 26. In this case, the first and second portions can be separately disposed in the outsides of the both sides of the recording medium 16 or the platen 20 in the width direction within the movement range of the ink-jet head 10. Alternatively, the first and second portions can be separately arranged in the outside of either side in the width direction.

In the present embodiment, the pair of bubble extracting paths 30 are provided for the ink-jet head 10. When each of the orifices 26 can perform a desired ink ejecting function, the ink-jet head 10 can include only one bubble extracting path 30 or a plurality of bubble extracting paths 30 which do not include one pair.

Furthermore, when each of the orifices 26 can realize the desired ink ejecting function, a configuration for allowing bubbles 34 in the upper portion of the ink storing chamber 10*a* to easily collect at the end of the bubble extracting path 30 connected to the upper portion of the ink storing chamber 10*a* can be formed in the upper portion of the ink storing chamber 10*a*.

Figure 7:
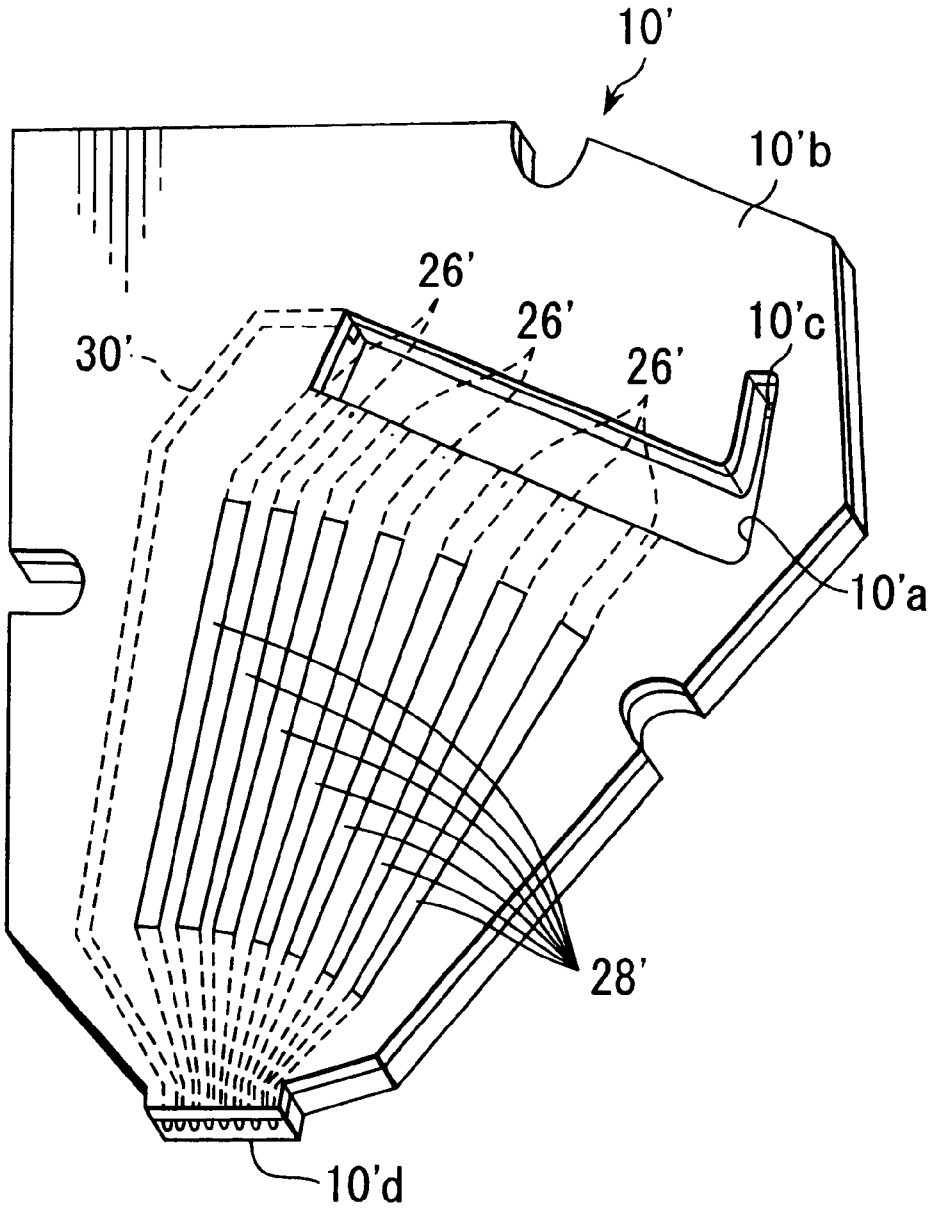
FIG. 7 is a schematic perspective view of an ink-jet head according to another embodiment of the present invention, in which an ink storing chamber, orifices, and a bubble extracting path are not filled with ink.

The configuration of an ink-jet head 10' according to another embodiment of the present invention will now be schematically described with reference to FIG. 7. Instead of the ink-jet head 10 according to the foregoing embodiment of the present invention described with reference to FIGS. 2 to 6, the ink-jet head 10' can be used together with the bubble extracting device 12 shown in FIG. 1 in the ink-jet type printing apparatus 14 shown in FIG. 1.

The basic configuration of the ink-jet head 10' is the same as that of the above-mentioned ink-jet head 10. Accordingly, in the ink-jet head 10', the elements corresponding to the elements of the foregoing ink-jet head 10 are designated by reference numerals each of which is obtained by adding a prime (') to the reference numeral designating the corresponding elements in the foregoing ink-jet head 10. The detailed description of these elements in the ink-jet head 10' is omitted.

The ink-jet head 10' is different from the foregoing ink-jet head 10 as follows.

Each of a plurality of ink ejection driving elements 28' comprises a piezoelectric element. In a main body 10*b*, a bubble extracting path 30' extends downward from the upper portion of an ink storing chamber 10*a* to a portion in the vicinity of openings at the ends of a plurality of orifices 26' which are opened on the bottom surface of the main body 10*b*.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet head which ejects ink in a downward direction, said ink-jet head comprising:

a member having an ink storing chamber to which ink is supplied, wherein the member includes:

at least one orifice mounted below the ink storing chamber and having a first end communicating with a lower portion of the ink storing chamber and a second end opened in a downward direction in an external space below the first end;

an ink ejection driving element which is mounted to correspond to the orifice and which ejects ink in the orifice from the second end of the orifice; and a bubble extracting path including a first end communicating with an upper portion of the ink storing chamber and a second end opened in a vicinity of the second end of the orifice.

2. The ink-jet head according to claim 1, wherein:

the orifice extends downward from the first end to the second end thereof, and the second end of the bubble extracting path faces downward.

3. The ink-jet head according to claim 2, wherein in the member, the second end of the orifice and the second end of the bubble extracting path are arranged so as to be adjacent to each other.

4. A combination of an ink-jet head which ejects ink in a downward direction and a bubble extracting device which eliminates bubbles in the ink-jet head, the ink-jet head comprising:

a member having an ink storing chamber to which ink is supplied, wherein the member comprises:

at least one orifice mounted below the ink storing chamber and having a first end communicating with a lower portion of the ink storing chamber and a second end opened in a downward direction in an external space below the first end;

an ink ejection driving element which is mounted to correspond to the orifice and which ejects ink in the orifice from the second end of the orifice; and a bubble extracting path including a first end communicating with an upper portion of the ink storing chamber and a second end opened in a vicinity of the second end of the orifice, and wherein while ink is not ejected from the second end of the orifice by the ink ejection driving element, the bubble extracting device sucks ink from the bubble extracting path and the upper portion of the ink storing chamber through the opening at the second end of the bubble extracting path.

5. The combination according to claim 4, wherein:

the orifice extends downward from the first end to the second end thereof, and the second end of the bubble extracting path faces downward.

6. The combination according to claim 5, wherein in the member, the second end of the orifice and the second end of the bubble extracting path are arranged so as to be adjacent to each other.

7. The combination according to claim 4, wherein the bubble extracting device also sucks ink in the orifice through the second end of the orifice while ink is not ejected from the second end of the orifice by the ink ejection driving element.

8. An ink-jet type printing apparatus comprising:

a recording medium conveyor which conveys a recording medium;

an ink-jet head which is located above the recording medium conveyed by the recording medium conveyor and which ejects ink in a downward direction to form a desired image on the conveyed recording medium; and a bubble extracting device which eliminates bubbles in the ink-jet head, wherein the ink-jet head comprises a member having an ink storing chamber to which ink is supplied, wherein the member comprises:

at least one orifice mounted below the ink storing chamber and having a first end communicating with a lower portion of the ink storing chamber and a second end opened in a downward direction in an external space below the first end;

an ink ejection driving element which is mounted to correspond to the orifice and which ejects ink in the orifice from the second end of the orifice; and a bubble extracting path including a first end communicating with an upper portion of the ink storing chamber and a second end opened in a vicinity of the second end of the orifice, and wherein the bubble extracting device sucks ink from the bubble extracting path and the upper portion of the ink storing chamber through the opening at the second end of the bubble extracting path while ink is not ejected from the opening at the second of the orifice by the ink ejection driving element.

9. The apparatus according to claim 8, wherein:

the orifice extends downward from the first end to the second end thereof, and the second end of the bubble extracting path faces downward.

10. The apparatus according to claim 9, wherein in the member, the second end of the orifice and the second end of the bubble extracting path are arranged so as to be adjacent to each other.

11. The apparatus according to claim 8, wherein the bubble extracting device also sucks ink in the orifice through the second end of the orifice while ink is not ejected from the second end of the orifice by the ink ejection driving element.

* * * * *